11/5/85 XR 4,551,692

United States Patent [19]

Smith

[11] Patent Number: 4,551,692

[45] Date of Patent: Nov. 5, 1985

[54] MONOLITHIC POLARIZER GRATING

[75] Inventor: Peter W. Smith, Westport, Conn.

[73] Assignee: United Technologies Corporation, Hartford, Conn.

[21] Appl. No.: 594,100

[22] Filed: Mar. 28, 1984

[51] Int. Cl.[4] ..... H01P 1/16

[52] U.S. Cl. ..... 333/21 A; 343/756; 343/909

[58] Field of Search ..... 333/21 A; 343/756, 909

[56] References Cited

U.S. PATENT DOCUMENTS 2,464,269 3/1949 Smith ..... 333/21 A X 4,156,213 5/1979 Shindo et al. ..... 333/21 A

*Primary Examiner*—Paul Gensler

*Attorney, Agent, or Firm*—Robert P. Sabath

[57] ABSTRACT

A dielectric substrate machined into a monolithic polarizer grating including structural support and matching regions, effective for transforming linearly to circularly polarized states of microwave radiation.

3 Claims, 8 Drawing Figures

MONOLITHIC POLARIZER GRATING

DESCRIPTION

1. Technical Field

This invention is directed toward the art of polarizer gratings, generally, and more particularly toward the art of monolithic polarizer gratings effective for transforming millimeter wavelength radar power between circularly and linearly polarized states.

2. Background Art

Radar systems presently used frequently employ linearly polarized microwave radiation for surveillance and to detect and track selected target objects. As is well known, such radar systems are subject to considerable undesired signal return from raindrops, causing clutter which tends to obscure desired signals. This effect is particularly pronounced in the millimeter wavelength region because the dimensions of raindrops are approximately equal to the wavelength of the radiation employed. When circularly polarized microwave radiation is transmitted, the raindrops reflect an opposte sense of the circular polarization transmitted, which is then rejected by the radar antenna upon return with the specialized circuitry employed for that purpose.

The target, of course, reflects in the same sense of circular polarization as transmitted, permitting its direct detection unobscured by rain clutter. The forms of polarized microwave radiation most conveniently generated according to the design of radar antennas and feeds are linear forms of polarization.

This has motivated the development of polarizer gratings effective for transforming linearly polarized microwave radiation to a circularly polarized form, and for transforming the return signal back to linearly polarized form on return from a target region.

In the past, the construction of the needed polarizer gratings has been difficult and relatively complicated. For example, among other methods of implementing the desired polarizing grating are those including such involved steps as the deposition of metal gratings on a substrate to act as capacitive or inductive irises with respect to orthogonal components of the transmitted microwave radiation, the use of parallel metal strips to increase the wavelength of a selected one of the radiation components, and the use of layers of different dielectric slabs, generally bonded together, to establish an effective anisotropic delay line. Moreover, in such constructions, to prevent the formation of undesired grating lobes, it is necessary to maintain grating spacings of about a half wavelength, which at millimeter wavelengths make construction much more difficult, and may have the undesired effect of rendering the polarizer grating exceedingly lossy.

Several solutions to these construction difficulties have been proposed, but none of them have been completely satisfactory. For example, the use of a subreflector as a polarizer has been proposed, since this would promote low microwave losses. However, machining grooves on a curved reflector is exceedingly difficult.

Accordingly, it is an object of the invention to achieve desired polarization transformation in a millimeter wavelength radar system, which relies upon the differential delay of orthogonal polarization components outside the primary horn of the radar antenna.

It is a further object of the invention to achieve said selectable polarization by the use of an anisotropic delay line.

It is a further object of the invention to develop an anisotropic delay line which is effective for operation at millimeter wavelengths.

It is a further object of the invention to develop an anisotropic delay line which is inexpensive and easy to manufacture.

It is a further object of the invention to make an anisotropic delay line polarizer which presents a matching interface for both of its orthogonal linear polarizations.

DISCLOSURE OF INVENTION

According to this invention, an anisotropic delay line including matching sections is made from a grating machined from a single slab of dielectric material by straight saw cuts only.

The polarizer grating operates by resolving a linear field vector into a pair of orthogonal components, one of which is then delayed for a quarter wavelength. When the two vectors are recombined in space after passing out of the polarizer medium, the recombined vector rotates about the direction of propagation at the carrier frequency, thus propagating with circular polarization.

The grating is positionable at forty five degrees to an incident linear electromagnetic field in order to convert the linear polarization of the incident radiation to a circularly polarized state.

BRIEF DESCRIPTION OF DRAWING

The invention is best understood by reference to the drawing including several figures, in which.

BEST MODE FOR CARRYING OUT THE INVENTION

Figure 1A:
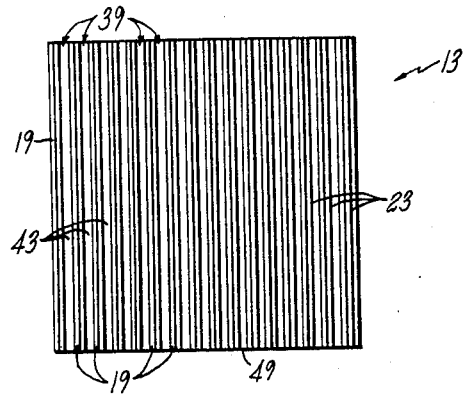
FIGS. 1A–1C show the construction of one version of the polarizer grating which is machined from a single slab of Rexolite® dielectric material.

FIG. 1A shows a top view of a polarizer grating 13 according to one version of the invention. In particular, the top view shows the difference in separation between the matching ridges 19 of a first matching layer 20, and the separation between the delay ridges 23 comprising an anisotropic delay region 27 of the monolithic structure, as shown even more clearly in FIG. 1B. Matching and delay troughs, respectively 39 and 43, are defined between the respective matching and delay ridges, 19 and 23. The respective ridges are held together by support region 49.

Figure 1B:
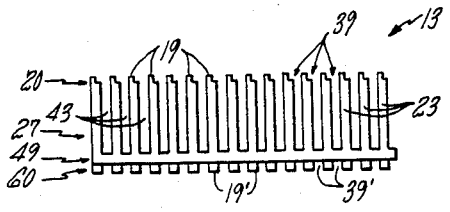

FIG. 1B shows a side view of a first embodiment of the invention in accordance with the scheme shown in FIG. 1A. This view particularly indicates the height of the anisotripic delay ridges 23, and the height of the ridges of both the first and second matching layers, respectively 20 and 60.

Figure 1C:
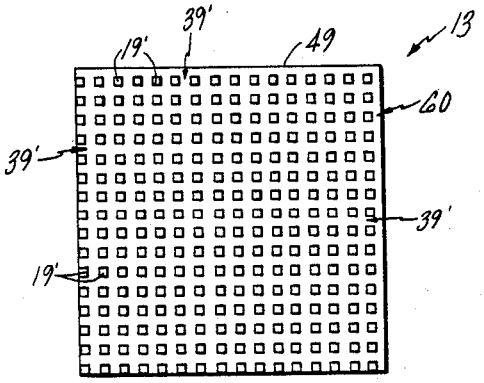

FIG. 1C shows the underside of the version of the invention indicated by FIG. 1A. In particular, the second matching layer is shown in terms of crossed troughs 39′, which are perpendicular to one another in this embodiment, and which define raised portions or heights 19′.

Figure 2A:
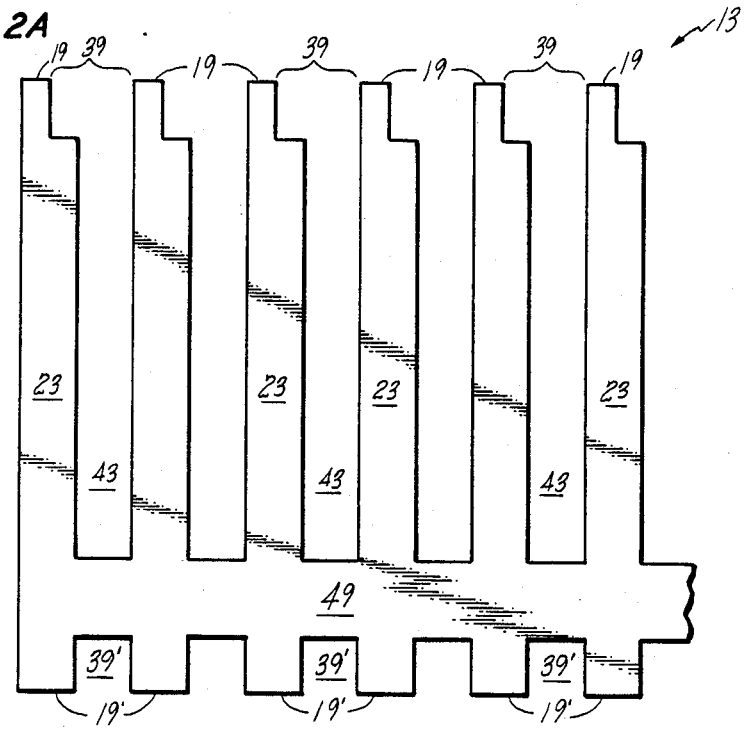
FIGS. 2A and 2B show details of the construction of the Rexolite® grating, in respective side and bottom views.
Figure 2B:
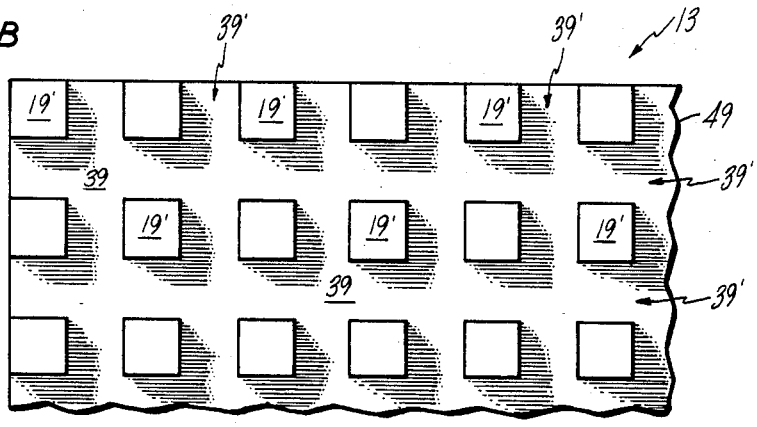

FIG. 2A shows a detail of the version of the invention in FIG. 1B, and FIG. 2B provides a detail of the underside of this embodiment, in both cases based upon a Rexolite ® material construction.

Figure 3A:
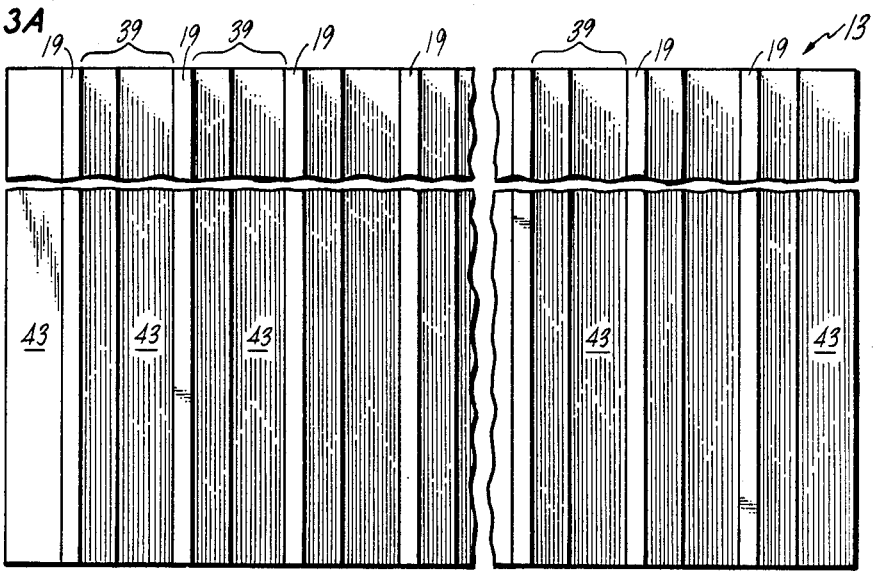
FIGS. 3A–3C show respective top, side and bottom views of a version of the invention made of alumina material, in each case with central portions of the polarizer grating broken away.
Figure 3B:
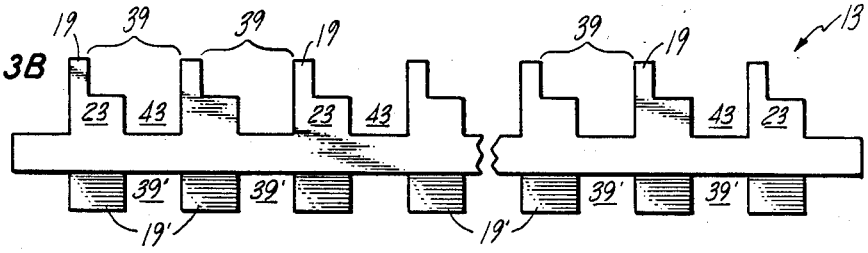
Figure 3C:
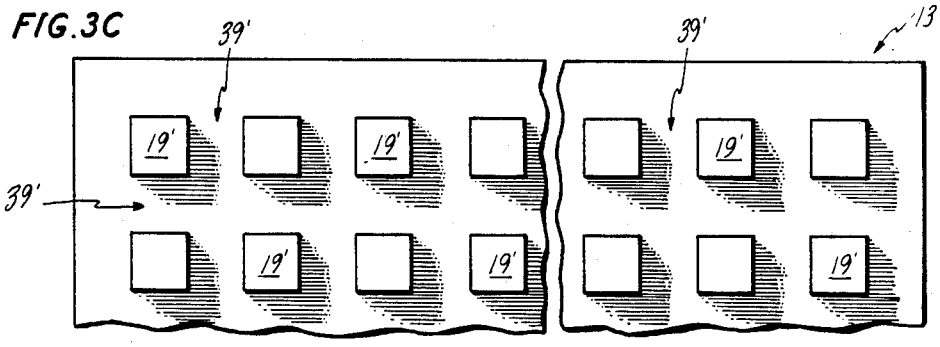

FIG. 3A shows a top view of a version of the invention constructed of alumina material, with the middle section thereof broken away; FIG. 3B in turn shows a side view of the same alumina version of the invention, again with the middle portion broken away (note the difference in dimension and proportion of this version with that shown in FIGS. 1A–1C); finally, FIG. 3C shows the bottom of this version of the invention. That the ridges or heights 19′ and 19 begin at the edge of one grating 13 and not at the edge of another is immaterial to the operation of the device.

To construct the invention, out of either Rexolite ® or alumina, or any of the materials indicated in Table I, a suitably sized piece of the material is acquired for machining. One suitable size is a one inch square block of material with a depth of one-third inch. Machining is suitably accomplished as for example by a diamond saw.

It is recommended that machining is accomplished with the troughs 39 or 39′ in the first or second matching layers, 20 or 60 respectively, being cut or otherwise established first. The troughs, 39 or 39′, are parallel to one another at spaced distances to be indicated below.

In the case of the bottom matching layer 60, a crossed pattern of perpendicular troughs 39′ is preferably machined into the matching layer 60. This version of a matching layer 60 is preferably provided on the underside of the polarizer 13 herein.

After the troughs and ridges (or "hills" in the case of a criss-crossed trough patterns) of the matching layers 20, 60 have been established, machining of the delay region 27 of the subtrate 13 begins, according to a preferred method of constructing the invention. This region 27 is preferably machined after the matching region 20 is established, because the machining of this region 27 penetrates deeper into the substrate 13, in fact substantially below the depth of the troughs 39 of the matching layer 20.

However, even though the troughs of the delay region 27 extend deeper than the troughs 39 of the matching layer 20, the individual troughs 43 thereof are not as wide.

The depth of the troughs, generally, in any case depends upon the material selected for the ridge, as will be seen.

More particularly, the construction of the polarizer grating 13 from a monolithic substrate is conducted in several states. First, the broadest troughs, these being the troughs of the matching layers 20 and 60, are formed by cutting action as with a diamond saw; then the deeper cuts are made to establish the troughs of the delay line region, until each of the various regions of the completed polarizer 13 are accounted for. As noted, these separate regions include the top matching region 20, the bottom matching region 60, a structural support region 49, and a middle region 27, which acts as a delay line effective for conversion between linearly polarized radiation states to circularly polarized radiation states, or vice versa.

Selecting the dimensions of the various grooves of the polarization requires some analysis. These dimensions depend upon, among other things, the material out of which the polarizer is constructed.

In particular, the dielectric constant of the material employed has a definitive impact on the exact dimensions and proportions of the completed polarizer.

Table I, which follows sets forth materials which can be employed in the construction of a dielectric polarizer 13 made according to the invention addressed herein. To the right of each material listed is its dielectric constant at microwave frequencies.

The preferred material in one version of the invention is the polystyrene Rexolite ® which is a low loss microwave dielectric material; in another version, alumina material is preferred. However, any of the dielectric materials indicated below in Table I and others like them can be employed.

TABLE I

| Material | Dielectric Constant |
|---|---|
| Pyroceram ® | 6.00 |
| Alumina | 9.14 |
| Rexolite 1422 ® | 2.57 |
| Polyimide/E-Glass Composite | 3.78 |
| MIL R-93004 Epoxy/E-Glass Composite | 4.41 |
| Teflon ® | 2.04 |
| Duroid 5880 ® | 2.62 |
| Lexan ® | 2.51 |

Region 27 performs as an anisotropic medium, because the selected dielectric taken in combination with air between ridges 23 exhibits different effective dielectric constants along a direction parallel to the ridges 23 and perpendicular to the ridges 23. More particularly, the polarizer 13 exhibits parallel and series dielectric constants, respectively $E_p$ and $E_s$, with respect to respectively a plane of polarization parallel to ridges 23, and a plane of polarization perpendicular to ridges 23.

As is well known in the art, the parallel dielectric constant $E_p$ equals the dielectric constant of the material selected for the polarizer 13 times the width of the ridge "d" plus one minus "d".

Moreover, the reciprocal of the series dielectric constant, one over $E_s$, equals the ridge width "d" divided by the material dielectric constant plus one minus "d".

Furthermore, the series dielectric constant equals the material dielectric constant divided by the quantity of the material dielectric constant minus the quantity of the product of "d" times the material dielectric constant minus one.

The establishment of ridges 19 for matching at the top of ridges 23 creates an additional anisotropic region which contributes to the delay line effect of region 27.

This creates a situation in which the respective parallel and series electric vectors of transmitted radiation are subject to phase shift contributions based upon both region 20 and 27. Regions 49 and 60 are isotropic and consequently do not affect the relative phase shifts between the two field vectors of the transmitted microwave radiation. Region 49 has thickness of one-half wavelength in the dielectric for optimum matching conditions for both linear polarizations.

Even more particularly, regions 20 and 27 each have independent series and parallel dielectric constants, respectively $E_{s1}$ and $E_{p1}$, and $E_{s2}$ and $E_{p2}$. In order effectively to transform electromagnetic radiation, between circular and linear polarization states, the following condition must be fulfilled:

$$\lambda_o/4 = h_{20}(\sqrt{E_{p1}} - \sqrt{E_{s1}}) + h_{27}(\sqrt{E_{p2}} - \sqrt{E_{s2}})$$

where:

$\lambda_o$ is the free space wavelength of the selected microwave radiation being transformed;

$h_{20}$ is the height of region 20;

$h_{27}$ is the height of region 27;

$E_{p1}$ is the effective parallel dielectric constant in region 20;

$E_{s1}$ is the effective series dielectric constant in region 20;

$E_{p2}$ is the effective parallel dielectric constant in region 27; and $E_{s2}$ is the effective series dielectric constant in region 27.

The width of troughs 43 equals the width of ridges 23 in order to optimize the differential phase shift between the parallel and series electric field vectors of the transmitted microwave radiation.

Next, the height of ridges 19 above the top ends of ridges 23 can be determined in conjunction with the widths of troughs 39 in order to optimize matching with respect to region 27. Since the effective parallel dielectric constant in region 20 is more significant than the effective series dielectric constant, the matching dimension of ridges 19 and troughs 39 are determined with regard to the effective parallel dielectric constant in region 20 only.

More particularly, the phase shift of the parallel electric vector is a function of the effective parallel dielectric constants of regions 20 and 27, and the phase shift of the series electric vector is a function of the effective series dielectric constants of the same regions. Additionally, in order to convert linear to circular polarization (or, vice versa) the difference in phase shift between the parallel and series dielectric constants through both of the regions is ninety degrees.

The solution of these relationships subject to the indicated restraints, permits determination of the height of ridges 23.

More particularly, the width of ridge 19 to obtain effective matching on the top side of the arrangement is determinable according to the following relationship, by solving for $x_1$.

$$E_{p1} = E_M x_1 + (1 - x_1) E_A$$

where:

$E_{p1}$ is the effective parallel dielectric constant in the matching region;

$E_M$ is the dielectric constant of the material selected for the monolithic polarizer;

$x_1$ is the width of the dielectric matching ridge 19;

$1 - x_1$ is the width of the airspace between successive matching ridges 19; and $E_A$ is the dielectric constant of air, which is equal to one (1).

Effective matching to the delay line region which has a known parallel dielectric constant, $E_{p2}$, according to the relationship immediately below, requires establishment of an effective parallel dielectric constant, $E_{p1}$, the definition of which also follows below.

More particularly, the known parallel dielectric constant $E_{p2}$ is established in view of a determination that the width of the troughs and ridges in the delay line ridges are equal in order to optimize the differential phase shift between the respective components of the selected microwave radiation. Accordingly, $$E_{p2} = (\tfrac{1}{2}) E_M + (\tfrac{1}{2}) E_A,$$

or the average of the dielectric constants of air and the dielectric material selected. Since $E_A = 1$, $$E_{p2} = (\tfrac{1}{2})(E_M + 1).$$

Also, the parallel dielectric constant of the matching layer must follow the matching condition relationship $$E_{p1} = \sqrt{E_{p2}}$$

or more precisely $$E_{p1} = (1/\sqrt{2})\, E_M + 1,$$

which is obtained by substituting the expression $(\tfrac{1}{2})(E_M + 1)$ for $E_{p2}$ in the immediately preceding relationship.

More particularly, an effective dielectric constant $E_{60}$ can be established by determining the geometric means of effective dielectric constants viewed in orthogonal directions. According to this approach, assuming the widths of the protrusions 19' are equal to the widths of the troughs 39', $$E_{60} = \sqrt{\frac{3E_M + 1}{E_M + 3}}$$

Furthermore, the height of the protrusions 19' are preferably equal to a quarter wavelength distance in the matching layer. Accordingly, the height of the protrusions 19' $h_{60}$ is determinable from the formula:

$$h_{60} = \lambda_o/(4\sqrt{E_{60}})$$

wherein, $h_{60}$ is the protrusion height;

$E_{60}$ is the effective dielectic constant in matching region 60; and $\lambda_o$ is the free space wavelength of the selected microwave radiation, which may for example be in the millimeter wavelength region.

The foregoing analysis is based on normal incidence propagation through the grating; however, adjustment of $h_{60}$ can be used to optimize performance at other angles of incidence encountered in practical horn-reflector systems.

The information above may suggest additional versions of the invention in the minds of those skilled in the art. Accordingly, reference is urged to the claims below, which specifically define the metes and bounds of the invention.

I claim:

1. In a substrate of dielectric material subject to incident propagating polarized microwave radiation capable of vector resolution with respect to components of a selected reference frame perpendicular to the direction of propagation, a monolithic polarizer comprising:

first anisotropic matching means for countering the reflection of microwave radiation;

anisotropic means adjacent said first matching means for transforming between linear and circular polarization states;

second matching means for countering the reflection of microwave radiation; and isotropic means for providing structural support with respect to said anisotropic means, said first and second matching means straddling said anisotropic and isotropic means, said isotropic and said anisotropic means cmprising the same material, whereby said incident propagating polarized microwave radiation changes polarization state in passing through said matching isotropic and said anisotropic means.

2. A method for making a monolithic polarizer comprising a single substrate of dielectric material subject to incident propagating polarized microwave radiation capable of vector resolution with respect to a selected reference frame perpendicular to the direction of propagation, including the steps of:

(a) establishing first anisotropic matching means for countering the reflection of microwave radiation;

(b) establishing adjacent to said first matching means an anisotropic means adjacent said first matching means for transforming between linear and circular polarization states;

(c) establishing second matching means for countering the reflection of microwave radiation;

(d) establishing isotropic means for providing structural support with respect to said anisotropic means, said first and second matching means straddling said anisotropic and isotropic means, said isotropic and anisotropic means comprising the same material, whereby said incident polarized microwave radiation changes polarization state in passing through said matching, said isotropic, and said anisotropic means.

3. The invention of claims 1 or 2, wherein said first matching layer comprises a series of parallel ridges in said substrate of dielectric material.

* * * * *